US007938703B2

(12) United States Patent
Mizokawa

(10) Patent No.: US 7,938,703 B2
(45) Date of Patent: May 10, 2011

(54) WATERCRAFT PROPULSION SYSTEM AND OPERATING METHOD

(75) Inventor: Takashi Mizokawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/575,486

(22) Filed: Oct. 8, 2009

(65) Prior Publication Data

US 2010/0068951 A1 Mar. 18, 2010

Related U.S. Application Data

(63) Continuation of application No. 11/841,510, filed on Aug. 20, 2007, now Pat. No. 7,614,924.

(30) Foreign Application Priority Data

Sep. 12, 2006 (JP) ..... 2006-246585

(51) Int. Cl.
*B63H 21/22* (2006.01)

(52) U.S. Cl. ..... 440/1

(58) Field of Classification Search ..... 440/1, 84
See application file for complete search history.

(56) References Cited

U.S. PATENT DOCUMENTS

| | | | | |
|---|---|---|---|---|
| 7,614,924 | B2 * | 11/2009 | Mizokawa | 440/1 |
| 2002/0023790 | A1 * | 2/2002 | Hata et al. | 180/65.3 |
| 2006/0025025 | A1 * | 2/2006 | Kitani et al. | 440/6 |

OTHER PUBLICATIONS

Mizokawa; "Watercraft Propulsion System and Operating Method"; U.S. Appl. No. 11/841,510, filed Aug. 20, 2007.

* cited by examiner

*Primary Examiner* — Stephen Avila
(74) *Attorney, Agent, or Firm* — Keating & Bennett, LLP

(57) ABSTRACT

A watercraft propulsion system has a control lever for giving instructions regarding the operating mode as well as the amount of output power from a source of driving force, and a controller for setting a propeller driving mode according to the instruction given by the control lever. When a reverse mode is instructed by the control lever, the controller sets the propeller driving mode depending on certain considerations such as user settings and battery charge. For instance, the controller may set the propeller driving mode to a mode in which the propeller is rotated in reverse by an electric motor or by the engine. Also, the controller may regulate electric power supply to the motor in light of battery charge. Other combinations are also contemplated.

3 Claims, 15 Drawing Sheets

[FIG. 14]
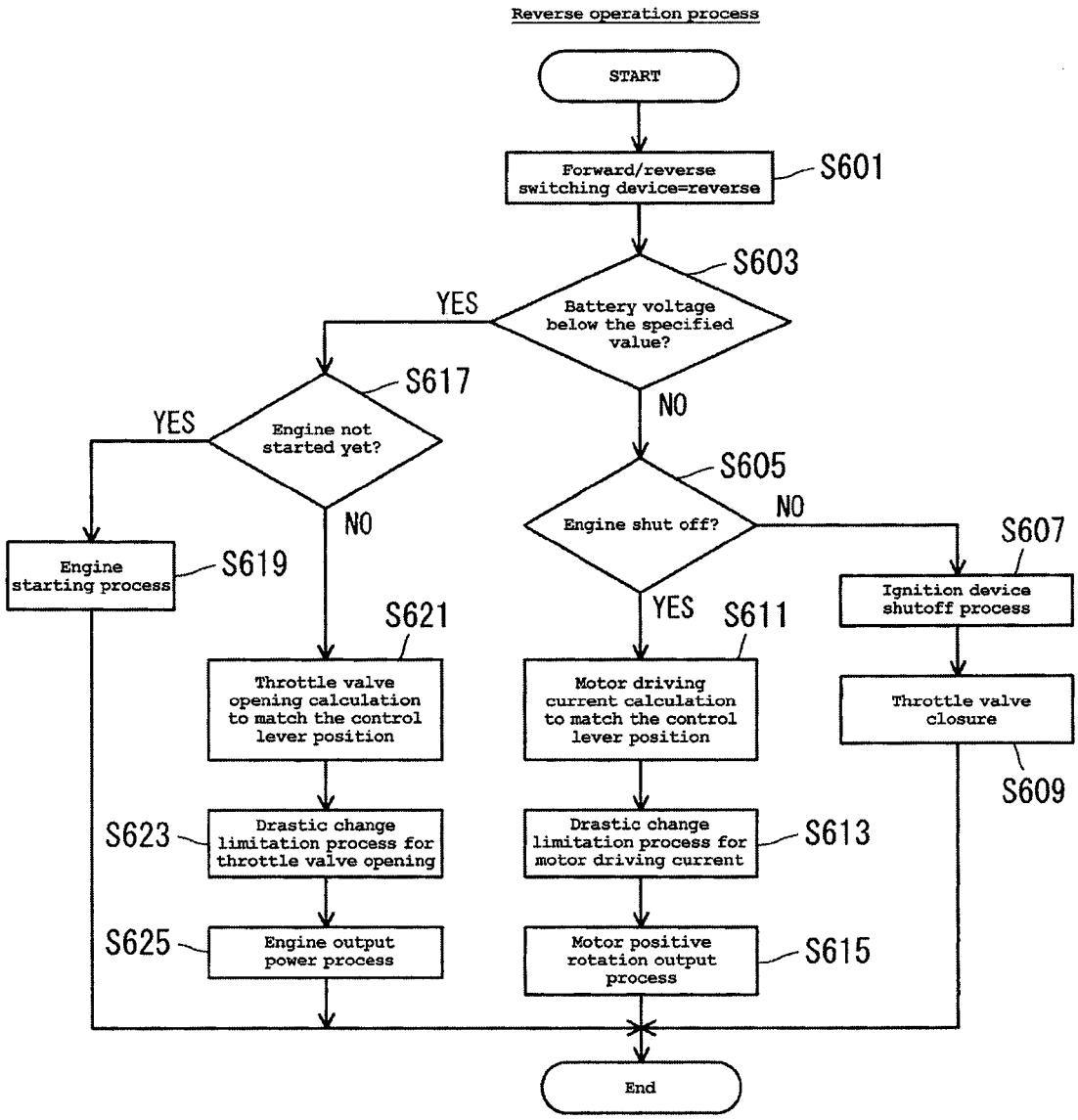

[FIG. 15]
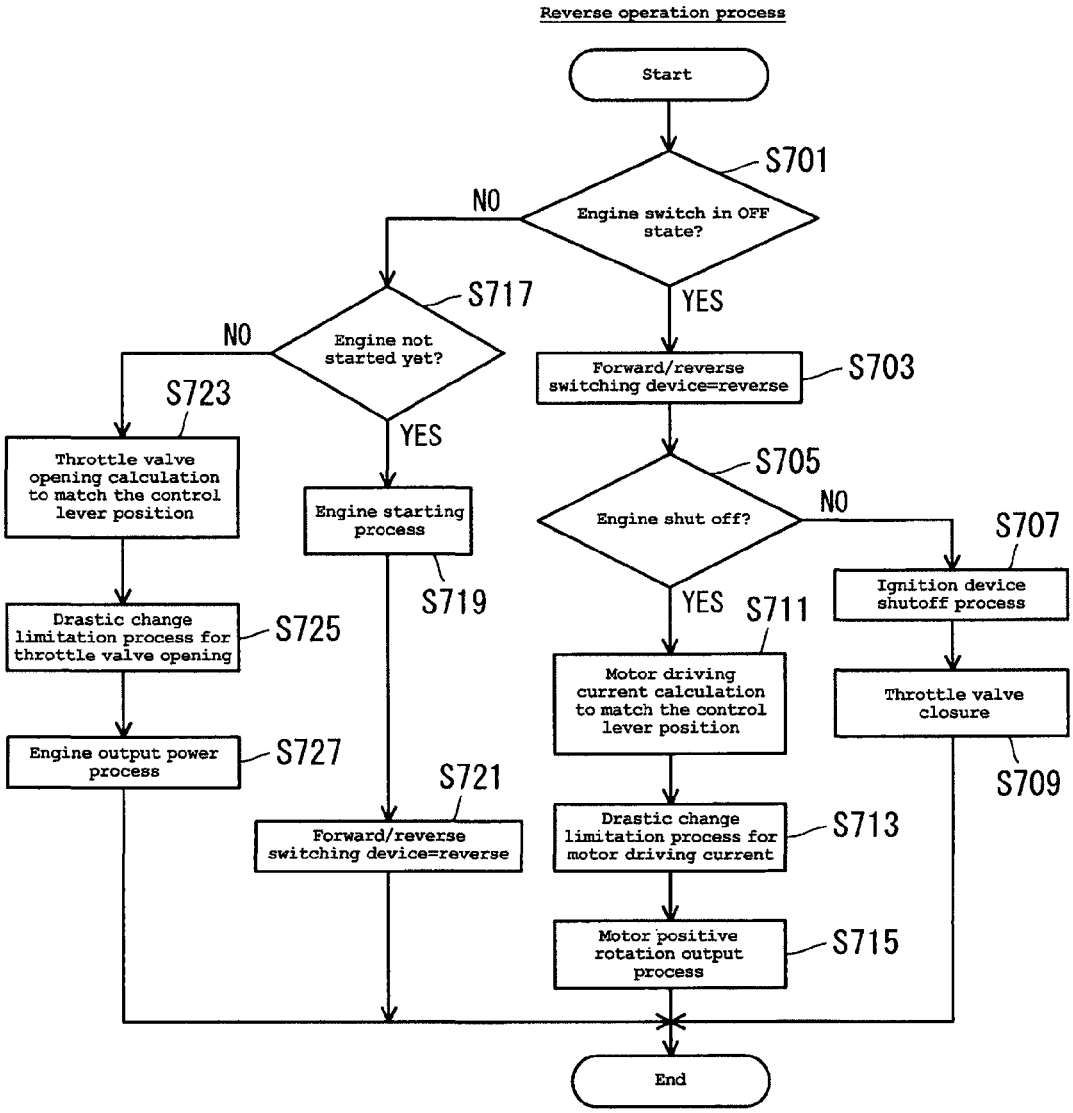

WATERCRAFT PROPULSION SYSTEM AND OPERATING METHOD

BACKGROUND OF THE INVENTION

1. Field of the Invention

The present invention relates to a hybrid-type watercraft propulsion system having an engine and an electric motor as a source of driving force for a propeller.

2. Description of Related Art

Japanese Publication No. JP-A-2004-257294 discloses a technique of assisting the driving power of an engine by the driving power of an electric motor for driving a power transmission device. However, this document is directed to engine operation consistency with electric motor operation on the assumption that the engine is always running when underway.

Japanese Publication No. JP-A-2006-36086, teaches a throttle grip that can be operated in a freely rotatable manner provided on a bar handle, and a control switch provided in the vicinity of the throttle grip. By operating the control switch, running and shut off of the engine and the electric motor, as well as the rotational direction of the electric motor can be controlled, and the rotational speeds of the electric motor and engine can be adjusted according to the turning operation of the throttle grip.

However, since both the control switch and the throttle grip must be used to control the running, shut off, and rotational speeds of the engine as well as the electric motor, the operation of such control means was troublesome.

SUMMARY OF THE INVENTION

Accordingly, there is a need in the art for a watercraft propulsion system and its operating method by which an engine and an electric motor can be controlled easily, and at the same time and the exhaust gas and the noise during the reverse operation can be suppressed.

In accordance with one embodiment, the present invention provides a watercraft propulsion system comprising an engine and an electric motor that are both configured to selectively drive a propeller. The system comprises a user instruction device and a controller. The user instruction device is configured so that a user can select a forward or reverse operating mode and an output power within the selected operating mode. The controller is adapted to receive a signal from the instruction device indicative of the desired operating mode and output power and to control the engine and electric motor accordingly. The controller is configured to evaluate at least a sensed condition of the system when the reverse operating mode is selected by the user instruction device and to select whether to drive the propeller with the engine or the electric motor.

In one such embodiment, the user instruction device comprises a control lever, and the position of the control lever simultaneously determines the selected operating mode and selected output power within the selected mode. In another such embodiment, the control lever is rotatable about an axis, and the position of the control lever is controllable by one hand.

Another embodiment additionally comprises a battery for storing electric power to be supplied to the electric motor, a charge level detector configured to detect a charge level in the battery, and an electricity generator adapted to be driven by the engine to charge the battery. The charge level detector communicates with the controller, and the controller is configured to determine based on at least the detected charge level whether the engine should be run during the reverse operating mode in order to charge the battery.

In one embodiment, the controller is configured so that if the detected charge level is less than a threshold level the engine is connected to drive the propeller in the reverse operating mode. In another embodiment, a connection between the engine and the propeller is disengaged in the reverse operating mode. In a further embodiment, the controller is configured so that if the detected charge level is less than a threshold level the engine is operated to charge the battery when the electric motor drives the propeller in the reverse operating mode. In a still further embodiment, the controller is configured so that if the detected charge level is less than a threshold level the output power of the electric motor is restricted.

In a yet further embodiment, the engine is operated at idle when the electric motor drives the propeller in the reverse operating mode. A still further embodiment comprises a forward/reverse switching device interposed between the propeller and both the engine and electric motor.

Yet a further embodiment additionally comprises a drive source switch communicating with the controller, wherein when the drive source switch is in a first position, the propeller is driven by the engine in the reverse mode, and if the drive source switch is in a second position the propeller is driven by the electric motor in the reverse mode so long as certain conditions are met.

In accordance with another embodiment, a method is provided for operating a watercraft propulsion system comprising an engine and an electric motor that are both configured to selectively drive a propeller and which are controlled by a controller. The method comprises receiving a user instruction selecting a reverse operating mode and an output power in the reverse operating mode, evaluating at least one sensor reading indicating a system condition, and selecting whether to drive the propeller with the electric motor or with the engine.

In one embodiment, the method further comprises sensing a battery charge level, and if the sensed battery charge level is below a threshold level, connecting the engine to the propeller and driving the propeller in the reverse mode with the engine. In another embodiment, if the sensed battery charge level is below a threshold level, the electric motor is operated at a restricted output power level. In yet another embodiment, if the sensed battery charge level is below a threshold level, the engine is operated without being connected to the propeller in order to charge the battery, and the electric motor drives the propeller in the reverse mode.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 14 is a flow chart showing an example of a reverse operation process according to the embodiment shown in FIG. 13.

FIG. 15 is a flow chart showing another example of a reverse operation process.

DETAILED DESCRIPTION OF THE PREFERRED EMBODIMENTS

Embodiments will be described below with reference to the drawings.

Figure 1:
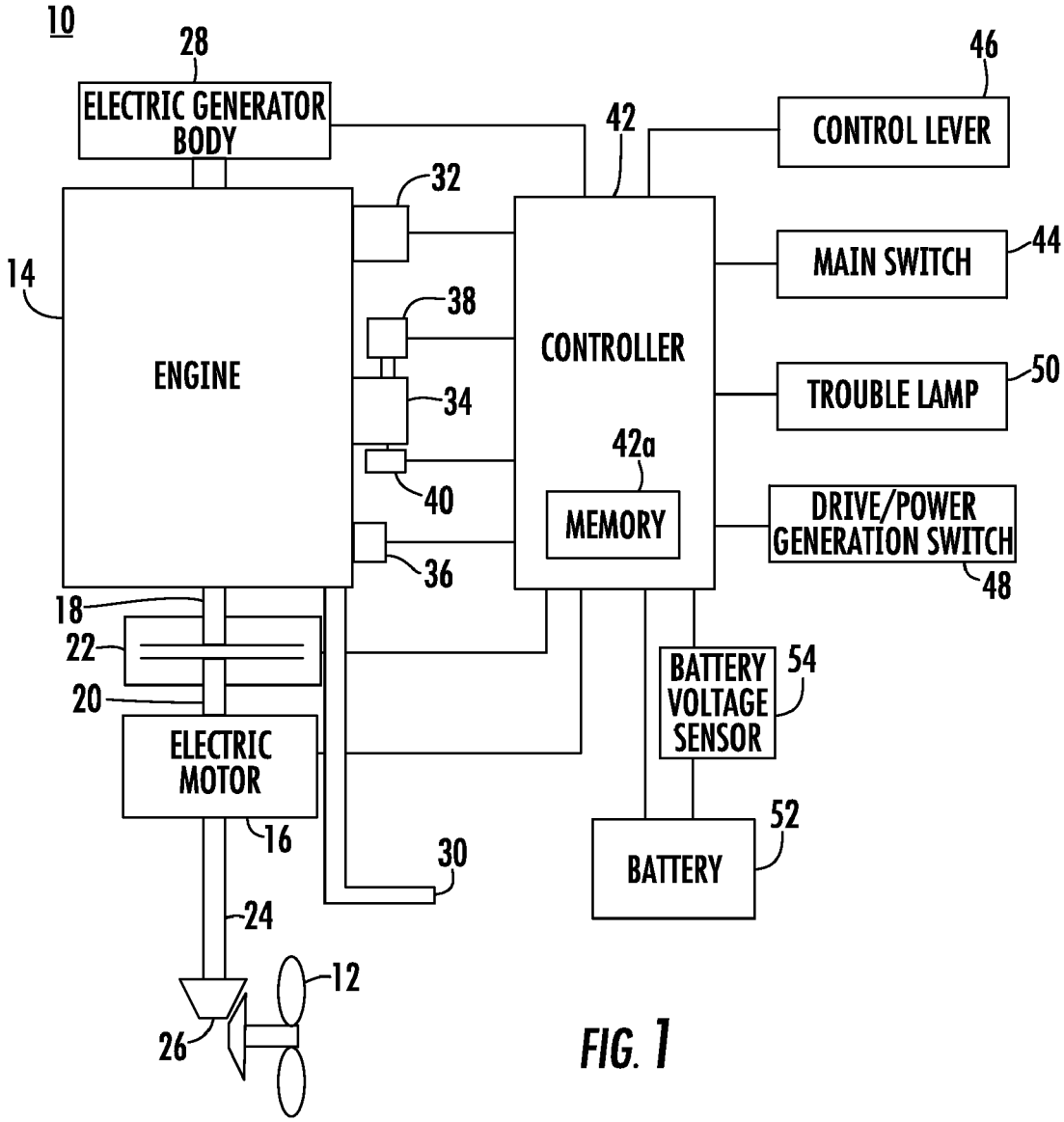
FIG. 1 is a schematic illustration showing a watercraft propulsion system according to one embodiment.

Referring first to FIG. 1, a watercraft propulsion system 10 according to an embodiment is of a hybrid type having a propeller 12, an engine 14 as a source of driving force for the propeller 12, and an electric motor 16. The illustrated embodiment is a center-motor type watercraft propulsion system in which the electric motor 16 is disposed between the engine 14 and the propeller 12. It should be noted that the watercraft propulsion system 10, as well as 10*b* and 10*c* that will be described later, may be configured as an outboard motor or in other configurations such as an inboard configuration, stern drive, or the like.

In the illustrated watercraft propulsion system 10, an electromagnetic clutch 22 is provided between a crankshaft 18 of the engine 14 and a rotor 20 of an electric motor 16. The crankshaft 18 and the rotor 20 are connected or separated by turning-on or turning-off the electromagnetic clutch 22. A driveshaft 24 is joined to the rotor 20 of the electric motor 16, and the driveshaft 24 is connected to the propeller 12 via a bevel gear 26. The rotational direction of the propeller 12 is decided by the rotational direction of the electric motor 16.

An electric generator body 28 used for engine power generation preferably is disposed on the top of the engine 14, and the electric generator body 28 connected to the upper end of the crankshaft 18. Also, an exhaust pipe 30 for discharging the exhaust gas into the water, an ignition device 32 for ignition of the engine 14, a throttle valve 34 for adjusting the amount of fuel delivered to the engine 14, and an engine speed sensor 36 for detecting the engine rpm (revolutions per minute) preferably are provided on the engine 14. A throttle motor 38 for driving the throttle valve 34, and a throttle opening sensor 40 for detecting the opening of the throttle valve 34 preferably are provided on the throttle valve 34. The exhaust pipe 30 preferably is provided so that the exhaust opening is located in the rearward of the propeller 12.

The electric motor 16, the electromagnetic clutch 22, the electric generator body 28, the ignition device 32, the engine speed sensor 36, the throttle motor 38, and the throttle opening sensor 40 preferably are connected to a controller 42. Further, a main switch 44 for starting (ON) or shut off (OFF) the operation of the watercraft propulsion system 10, a control lever 46 for giving instructions on the types of operating mode as well as on the amount of output power from the source of driving force, a drive/power generation switch 48 for selectively setting the driving function or power generation function, a trouble lamp 50 to make a trouble annunciation, a battery 52 composed of a 24V battery, for instance, and a battery voltage sensor 54 for detecting the voltage of the battery 52 preferably are connected to the controller 42.

The controller 42 preferably receives: signals indicating the opening of the throttle valve 34 by the throttle opening sensor 40, signals indicating the rpm of the engine 14 by the engine speed sensor 36, ON/OFF signals by the main switch 44, lever position signals indicating the type of operating mode and amount of output power from the source of driving force by the control lever 46, setting signals indicating driving function or power generation function by the drive/power generation switch 48, and signals indicating the battery voltage by the battery voltage sensor 54. In addition, an electric power obtained by the engine power generation at the electric generator body 28 preferably charges up the battery 52 via the controller 42.

Further, the controller 42 preferably delivers ignition instructions to the ignition device 32, driving signals to the throttle motor 38, ON/OFF signals to the electromagnetic clutch 22, driving signals and the electric power from the battery 52 to the electric motor 16, and lamp lighting signals to the trouble lamp 50.

Additionally, the controller 42 preferably includes a memory 42*a*. A program for implementing operations such as those depicted in FIGS. 4 through 7 are stored in the memory 42*a*. Further, operation data, a specified value to be compared with the battery voltage, table data showing a corresponding relation between the position of the control lever 46 and the output power from the source of driving force, and so on are stored in the memory 42*a*.

In one embodiment, the control lever 46 represents an instruction means. The controller 42 represents a setting means, a first determination means, and a second determination means. The battery voltage sensor 54 represents a charge level detecting means.

Next, referring to FIGS. 2 and 3, the relationship between the position of the control lever 46 and the types of operating mode, or the output power from the source of driving force in accordance with one embodiment will be described.

Figure 2:
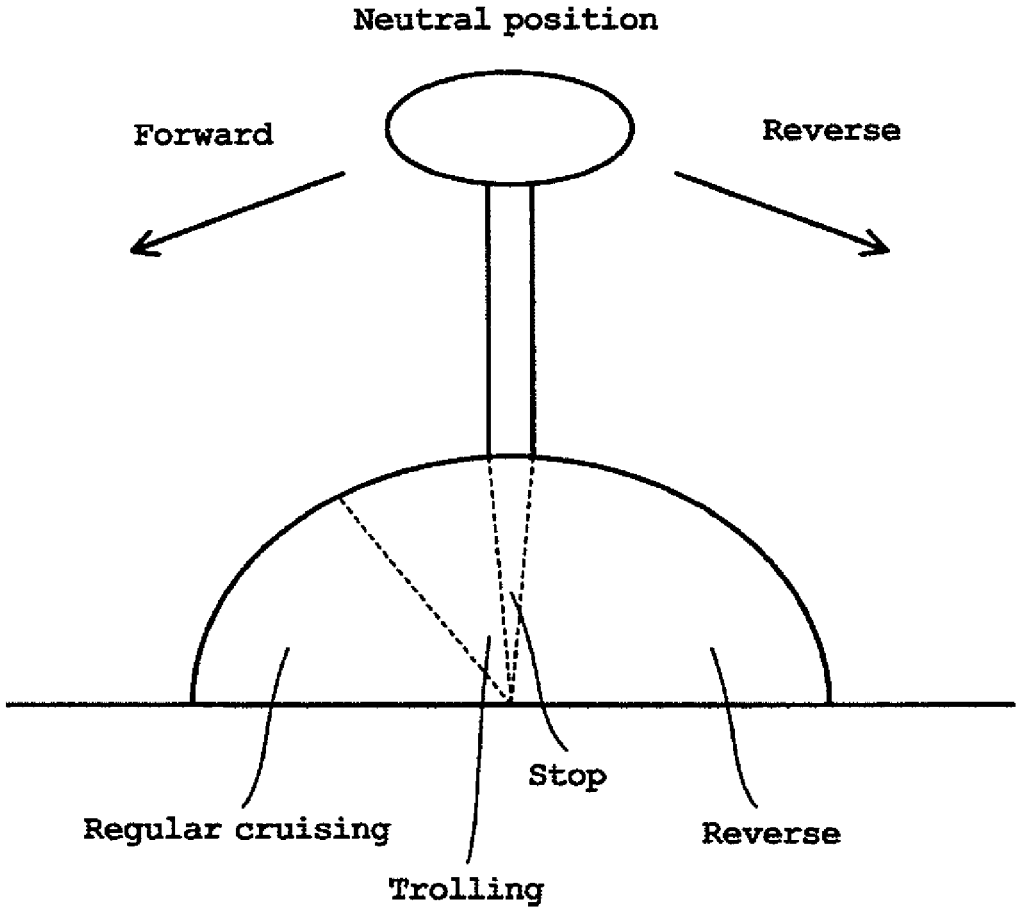
FIG. 2 is an illustration showing a control lever.

As shown in FIG. 2, the control lever 46, rotatable forward and backward, can give an instruction on the types of operating mode (regular cruising, trolling, stop, or reverse) by its lever position. At the same time, it can give an instruction on the amount of output power from the source of driving force by its lever position as shown in FIG. 3.

A prescribed range extending in the forward and backward direction around the neutral position of the control lever 46 is a stop mode. A prescribed range in the forward side of the stop mode range is a trolling mode. A range farther in the forward side of the trolling mode range is a regular cruising mode. Also, a range in the backward section of the stop mode range is a reverse mode.

In this arrangement, instructions for the types of operating mode and the amount of output power from the source of driving force can be given easily and continuously by the rotating operation of the control lever 46, resulting in a remarkable improvement of the controllability.

Figure 3:
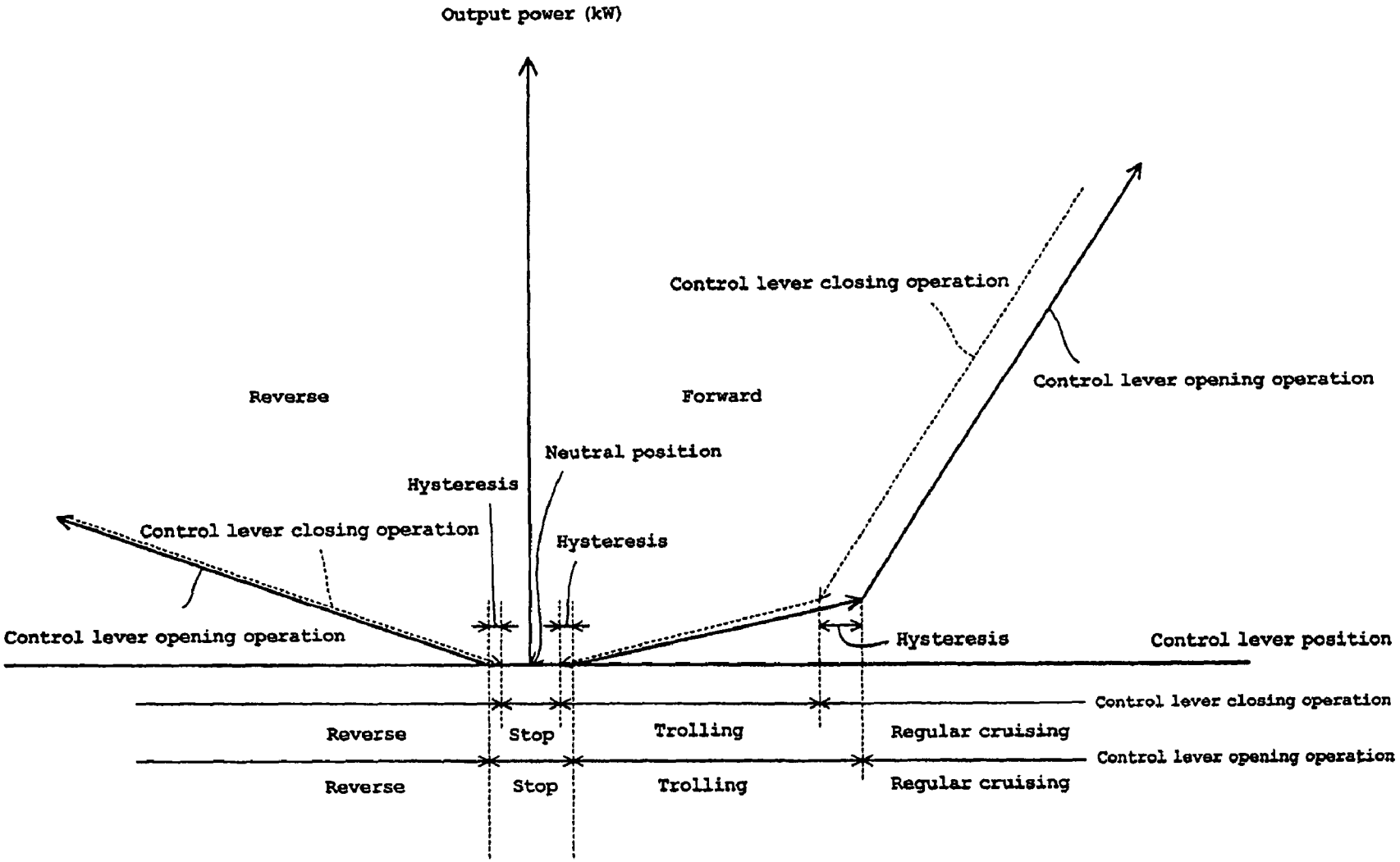
FIG. 3 is a chart showing corresponding relations between a control lever position and the output power from a source of driving force.

Further, as shown in FIG. 3, a so-called hysteresis is provided in one embodiment by which the mode switching position of the control lever 46 is different in the opening operation that moves the control lever farther from the neutral position in comparison with such position in the closing operation that moves the control lever closer to the neutral position. In this way, some "play" is provided in the mode switching process, preventing frequent mode switching around the boundary of the abutting modes.

Figure 4:
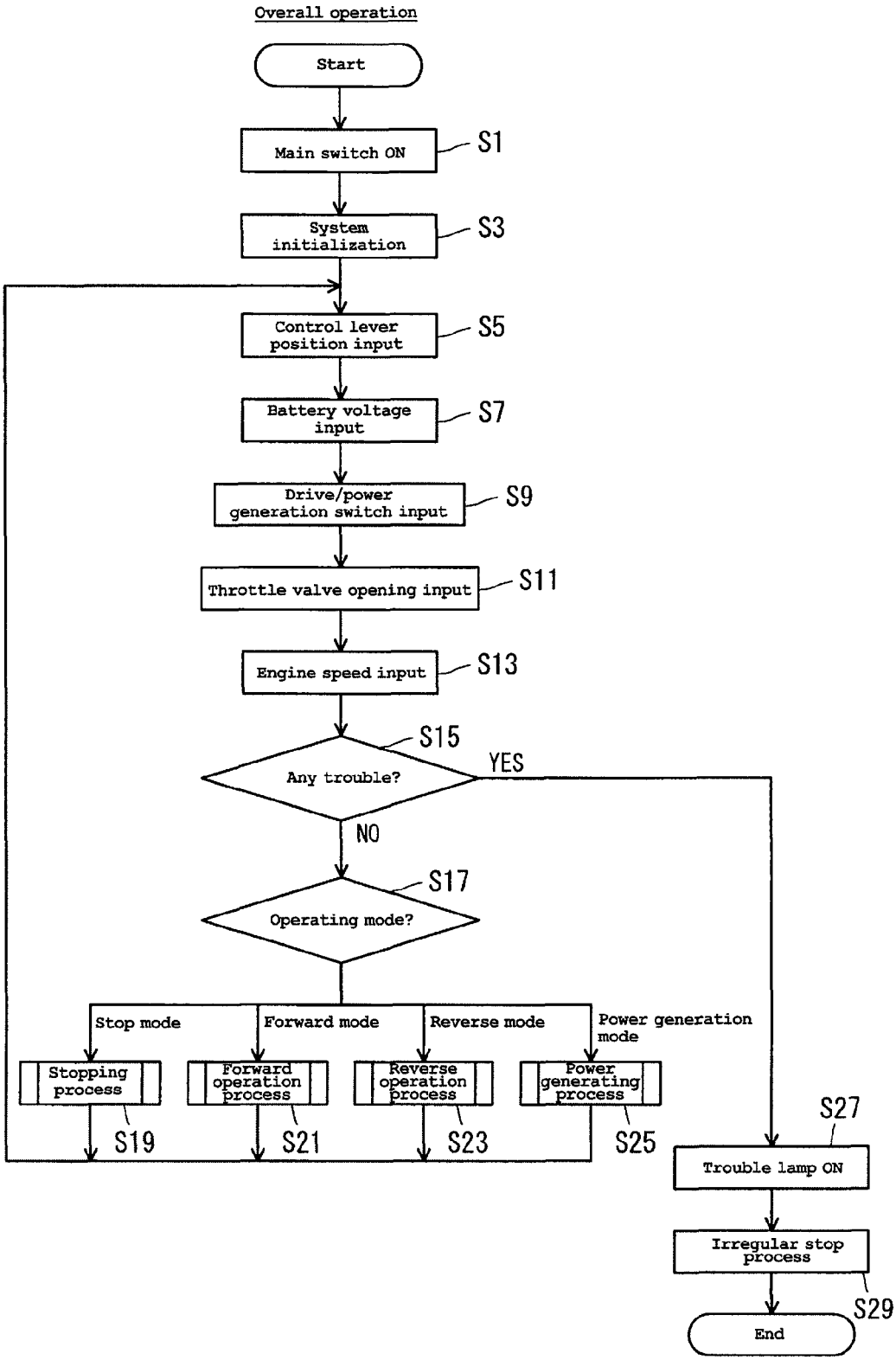
FIG. 4 is a flow chart showing the overall operation of the watercraft propulsion system of FIG. 1.

Overall operation of an embodiment of such a watercraft propulsion system will be described with reference to FIG. 4.

First, the system is initialized (step S3) when the main switch 44 is pressed down (step S1). The system initialization includes setting of the electromagnetic clutch 22 at OFF state, for instance.

Next, the lever position signal of the control lever 46 is input into the controller 42 (step S5), and the signal indicating the battery voltage detected by the battery voltage sensor 54 is input into the controller 42 (step S7). Further, the setting signal from the drive/power generation switch 48 is input into the controller 42 (step S9), followed by the input of the signal indicating the opening of the throttle valve 34 (throttle position) detected by the throttle opening sensor 40 (step S11), and the input of the signal indicating the engine rpm detected by the engine speed sensor 36 (step S13). The controller 42 detects trouble in the watercraft propulsion system 10 based on at least these input information (step S15), and the operating mode is determined if there is no trouble (step S17).

In the illustrated embodiment, the shut off process is implemented if the operating mode is the stop mode (step S19), the forward operation process is implemented if it is a forward mode (step S21), the reverse operation process is implemented if it is the reverse mode (step S23), and the power generating process is implemented if it is the power generation mode (step S25). Then, the process returns to the step S5.

If any trouble is detected in the watercraft propulsion system 10 in step S15, the trouble lamp 50 comes on according to the instruction by the controller 42 (step S27), the irregular stop process is implemented (step S29), and the process is terminated.

Figure 5:
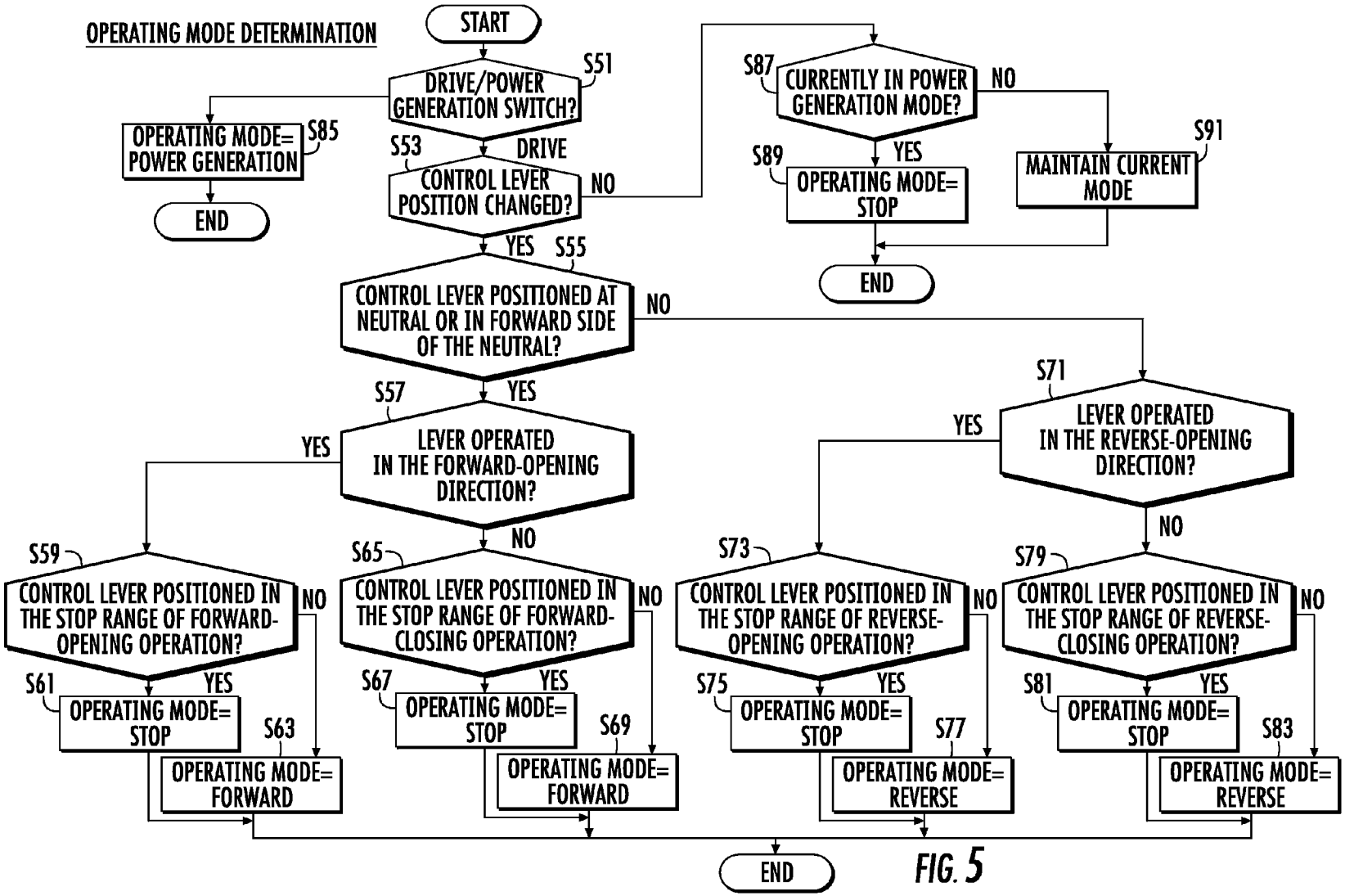
FIG. 5 is a flow chart showing the operating mode determination process in step 17 of FIG. 4.

Here, an embodiment of the operating mode determination process shown as the step S17 in FIG. 4, will be explained in detail with reference to FIG. 5.

First, the controller 42 determines whether the setting signal from the drive/power generation switch 48 indicates power generation or driving (step S51), and if the signal indicates driving, the controller 42 determines whether the position of the control lever 46 has changed or not (step S53). If the lever position has changed, determination is made whether the control lever 46 is at the neutral position or in the forward side of the neutral position (step S55). If the control lever 46 is at the neutral position or in the forward side of the neutral position, determination is made whether the operating direction of the control lever 46 is in the forward-opening direction (step S57). The operating direction of the control lever 46 can be determined based on the lever position in the previous control cycle and that in the present control cycle.

If the operating direction of the lever is determined to be in the forward-opening direction in step S57, then, determination is made whether the control lever 46 is positioned in the stop range associated with the forward-opening operation (step S59). If the lever is positioned in the stop range, the operating mode is determined to be the stop mode (step S61). On the contrary, if the lever is not positioned in the stop range associated with the forward-opening operation in step S59, the operating mode is determined to be the forward mode (step S63). In the illustrated embodiment, when the operating mode is determined to be the forward mode, it is initially determined to be the trolling mode.

If the operating direction of the control lever 46 is determined to be in the forward-closing direction in step S57, then, determination is made whether the lever is positioned in the stop range associated with the forward-closing operation (step S65). If the lever is positioned in the stop range, the operating mode is determined to be the stop mode (step S67). On the contrary, if the lever is not positioned in the stop range associated with the forward-closing operation in step S65, the operating mode is determined to be the forward mode (step S69).

If the control lever 46 is in the reverse side relative to the neutral position in step S55, then, the process goes to step S71. In step S71, determination is made whether the operating direction of the control lever 46 is in the reverse-opening direction, then, if it is in the reverse-opening direction, determination is made whether the lever is positioned in the stop range associated with the reverse-opening operation (step S73). If the lever is positioned in the stop range, the operating mode is determined to be the stop mode (step S75). On the contrary, if the lever is not positioned in the stop range associated with the reverse-opening operation in step S73, the operating mode is determined to be the reverse mode (step S77).

If the operating direction of the control lever 46 is determined to be in the reverse-closing direction in step S71, then, determination is made whether the lever is positioned in the stop range associated with the reverse-closing operation (step S79). Then, if the lever is positioned in the stop range, the operating mode is determined to be the stop mode (step S81). On the contrary, if the lever is not positioned in the stop range associated with the reverse-closing operation in step S79, the operating mode is determined to be the reverse mode (step S83).

Further, if the drive/power generation switch 48 is set for power generation in step S51, the operating mode is determined to be the power generation mode (step S85).

If there is no change in the position of the control lever 46 in step S53, determination is made whether the present mode is the power generation mode or not (step S87). If the present mode is the power generation mode, the operating mode is determined to be the stop mode (step S89). On the other hand, if the present mode is not the power generation mode in step S87, the present mode is maintained (step S91).

Figure 6:
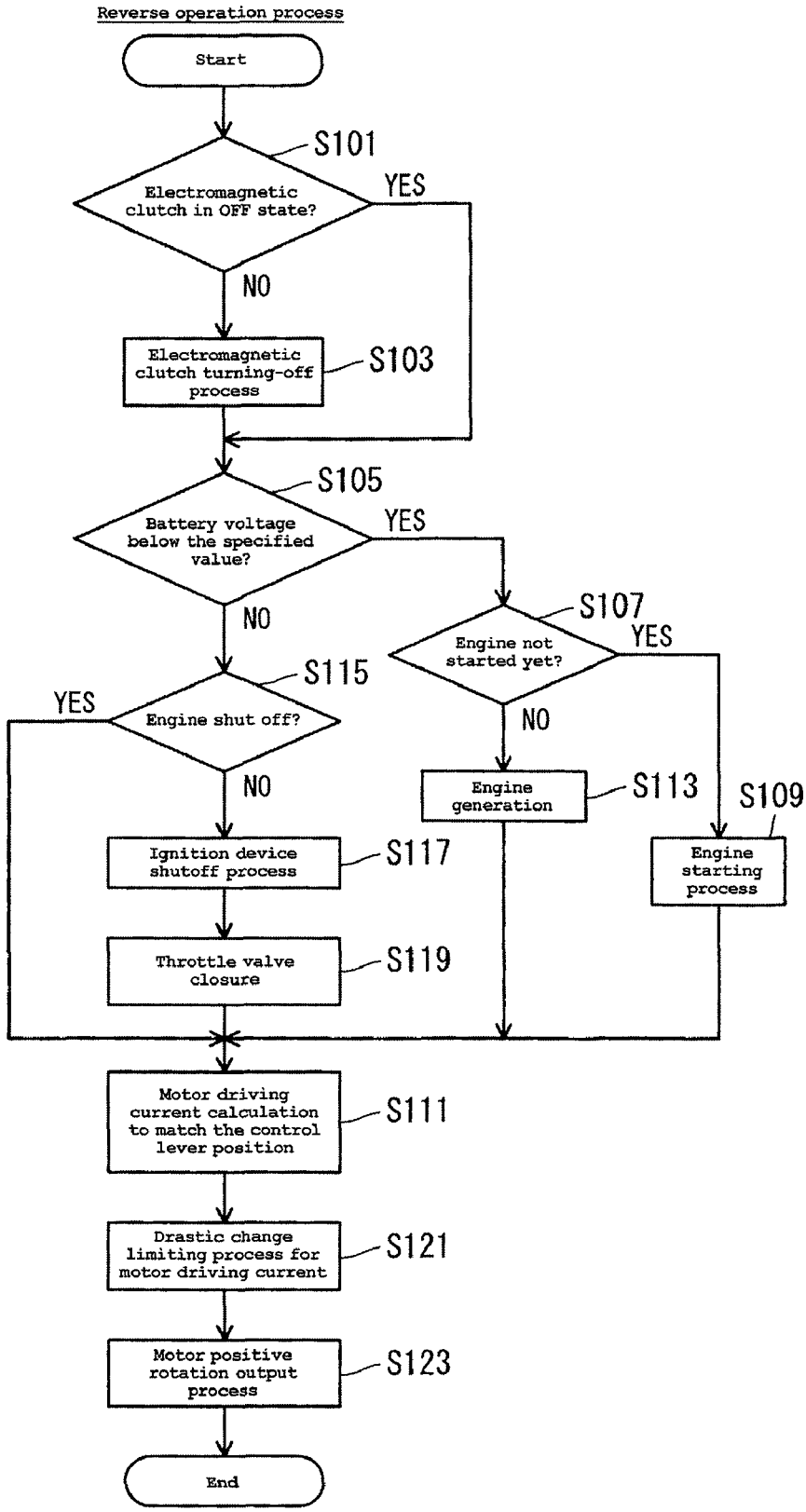
FIG. 6 is a flow chart showing an example of a reverse operation process.

Next, an operation example regarding an embodiment of the reverse operation process in accordance with the system of FIG. 4 as step S23 will be described with reference to FIG. 6.

When the controller 42 determines that the operating mode is the reverse mode, the propeller driving mode is set to a first mode in which the propeller 12 is rotated in reverse by the electric motor 16, and the amount of output power from the electric motor 16 is adjusted according to the instruction given by the control lever 46. In other words, step S101 and the subsequent processes are implemented.

First, the controller 42 determines whether the electromagnetic clutch 22 is turned off or not (step S101). If the electromagnetic clutch 22 is turned on, the turning-off process for the electromagnetic clutch 22 is implemented (step S103), and the process goes to step S105. If the electromagnetic clutch 22 is turned off, the process goes to step S105 directly.

In step S105, the controller 42 determines whether the voltage of the battery 52 is below the specified value or not (step S105).

If the battery voltage is below the specified value, the controller 42 determines the motor driving mode to be a third mode, in which the electric motor 16 is driven by the electric power from the battery 52, and in parallel, the electric power obtained by the engine power generation is charged into the battery 52. In other words, the process goes to step S107. Then, determination is made in step S107 whether the engine has not been started yet. If the engine has not been started yet, the engine starting process is implemented (step S109), and the process goes to step S111.

If the engine has already been started in step S107, the engine speed is controlled to obtain the prescribed amount of power generation, the engine power generation is implemented (step S113), and then, the process goes to step S111.

If the battery voltage exceeds the specified value in step S105, the controller 42 determines the motor driving mode to be a fourth mode, in which the electric motor 16 is driven by the electric power from the battery 52. In other words, the process goes to step S115. Since the engine start is not required in the fourth mode, determination is made whether the engine 14 is shut off or not in step S115. If the engine 14 is shut off, the process goes to step S111, but if the engine 14 is running, the shutoff process for the ignition device 32 is implemented (step S117), the throttle valve 34 is closed (S119), and the process goes to S111.

In step S111, the controller 42 calculates the electric motor driving current to be supplied to the electric motor 16, with reference to table data showing the corresponding relations of FIG. 3, so that the motor output power is obtained in response to the position of the control lever 46. Then, a drastic change limiting process is implemented to prevent the electric motor driving current from changing sharply (step S121), the reverse rotation output process for the electric motor 16 is implemented (step S123).

The processes described above make the watercraft propulsion system 10 run backward by rotating the propeller 12 in reverse, and then the processes are terminated.

According to the operation example embodiment described above, instructions for the types of operating mode as well as the amount of output power from the source of driving force can be given easily and continuously by rotating operation of the single control lever 46, resulting in simple control of the engine 14 and the electric motor 16. Especially, the forward mode or the stop mode can be switched to the reverse mode by a simple operation using a single control lever 46. Additionally in the reverse mode, the propeller driving by the electric motor 16 can make the watercraft propulsion system 10 run backward smoothly, and at the same time exhaust gas and noise during the reverse operation can be suppressed.

Also, in the first mode, the electric motor 16 preferably is driven by electric power supplied by the battery 52 when the battery voltage exceeds the specified value, while on the other hand the electric motor 16 is driven by the electric power supplied by the battery 52, and in parallel, the electric power obtained by the engine power generation is charged into the battery 52 when the battery voltage is below the specified value. In this way, deterioration of the battery 52 due to over discharge can be prevented.

Further in the first mode, when electric power is supplied by the engine power generation using the engine 14, with the propeller 12 being separated by turning-off the electromagnetic clutch 22, the engine speed can be controlled without regard to the rotational speed of the propeller 12, and the adequate amount of charging power can be obtained.

In addition, when the propeller is driven by the electric motor 16, no exhaust gas is discharged toward the rear of the propeller 12, and there will be no power loss due to the jet flow of the exhaust gas. Further, ventilation is prevented because no exhaust gas is entangled in the propeller 12.

Figure 7:
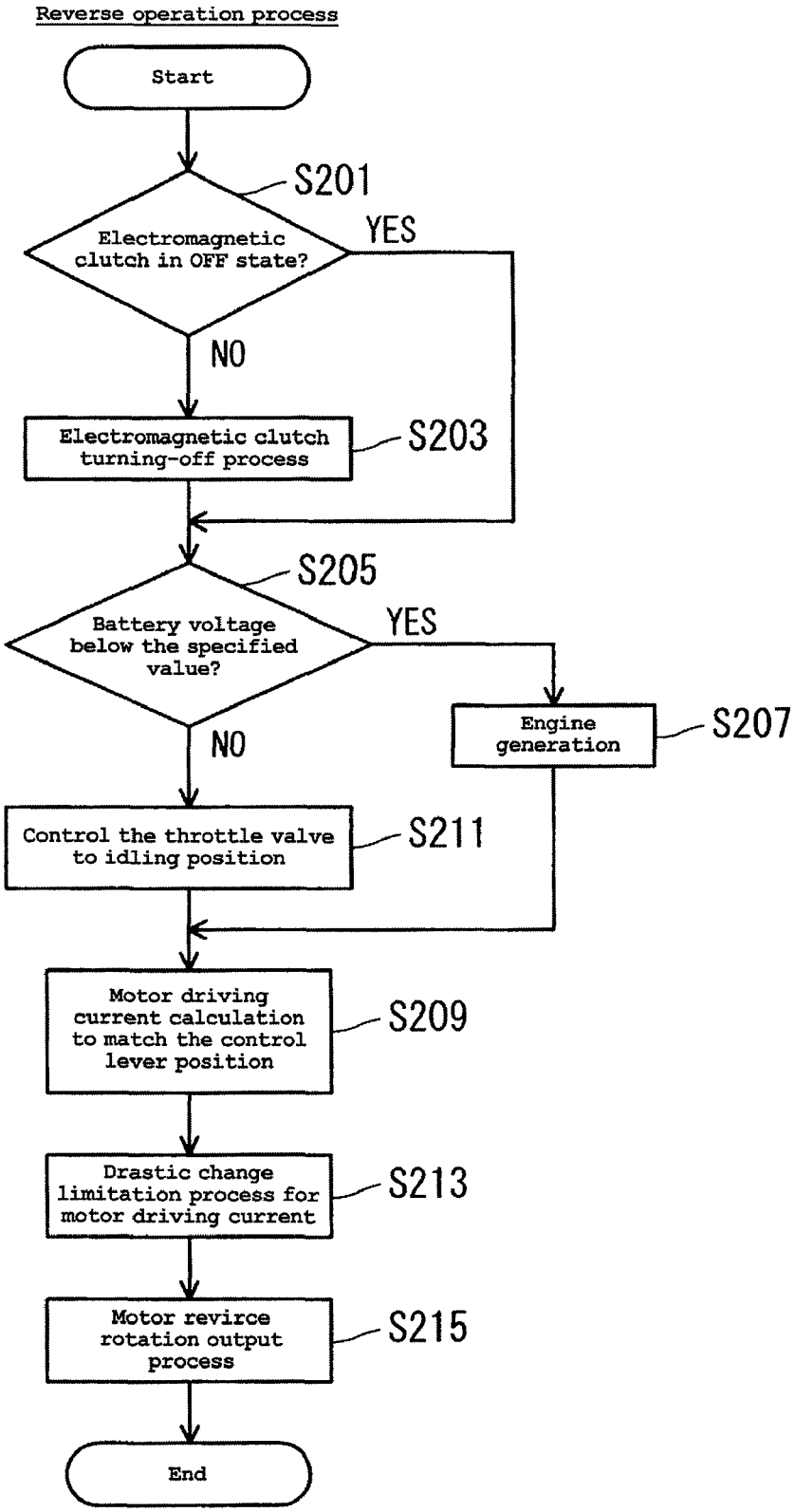
FIG. 7 is a flow chart showing another example of a reverse operation process.

Another operation example regarding an embodiment of a reverse operation process for the watercraft propulsion system 10 will be explained with reference to FIG. 7.

When the controller 42 determines that the operating mode is the reverse mode, the propeller driving mode is set to the first mode, and the step S201 and the subsequent processes are implemented.

First, the controller 42 determines whether the electromagnetic clutch 22 is turned off or not (step S201). If the electromagnetic clutch 22 is turned on, the turning-off process for the electromagnetic clutch 22 is implemented (step S203), and the process goes to step S205. If the electromagnetic clutch 22 is turned off, the process goes to step S205 directly.

In step S205, the controller 42 determines whether the voltage of the battery 52 is below the specified value or not.

If the battery voltage is below the specified value, the engine speed is controlled so as to obtain the prescribed amount of power generation, and engine power generation is implemented (step S113). The process then goes to step S111.

If the battery voltage exceeds the specified value in step S205, the throttle valve 34 is controlled to the idling position by the controller 42 (step S211), and the process goes to step S209.

In step S209, the controller 42 calculates the electric motor driving current with reference to the table data showing the corresponding relations of FIG. 3, so that the motor output power is obtained in response to the position of the operating lever 46. Then, a drastic change limiting process is implemented to prevent the electric motor driving current from changing sharply (step S213), and the reverse rotation output process for the electric motor 16 is implemented (step S215).

Through the processes described above, the watercraft propulsion system 10 runs backward by rotating the propeller 12 in reverse.

In this operation example, the engine 14 is operated at idle while the electric motor 16 is driven by the electric power from the battery 52 in the first mode, allowing swift transition to a second mode without re-starting the engine 14 thereafter.

Figure 8:
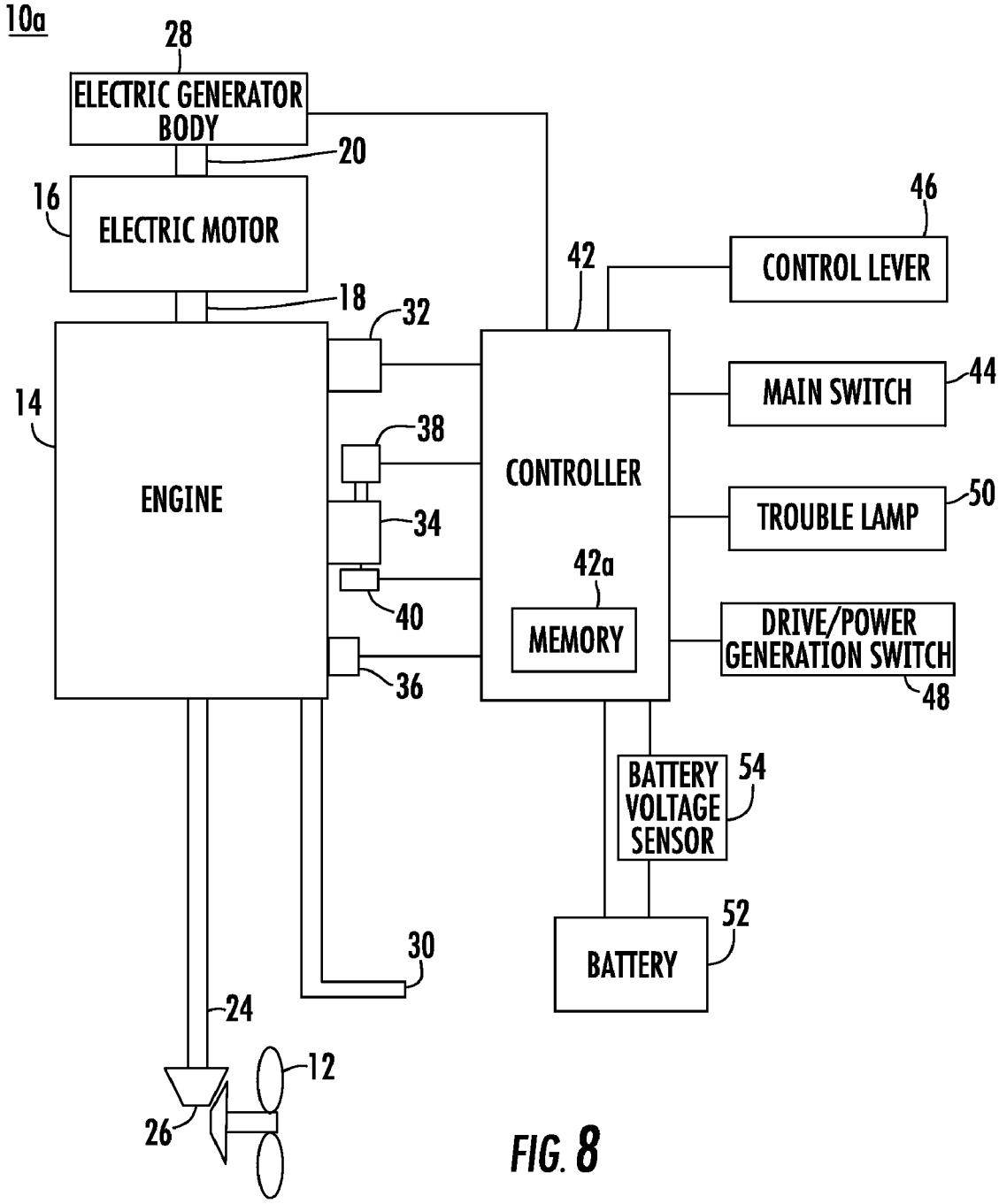
FIG. 8 is an illustration showing a watercraft propulsion system according to another embodiment.

A watercraft propulsion system 10*a* according to another embodiment will be described with reference to FIG. 8.

The illustrated watercraft propulsion system 10*a* is configured as the motor on top type in which the electric motor 16 is provided on the top of the engine 14 without using the electromagnetic clutch 22. In addition, the driveshaft 24 is joined to the lower end of the crankshaft 18 of the engine 14, the rotor 20 of the electric motor 16 is joined to the upper end of the crankshaft 18, and the electric generator body 28 is provided on the upper end of the rotor 20. Preferably, a program for implementing the operations shown in FIG. 9 and other items are stored in the memory 42*a*. The rest of the configuration is the same as or similar to the watercraft propulsion system 10, and the description for duplicate parts will be skipped.

Figure 9:
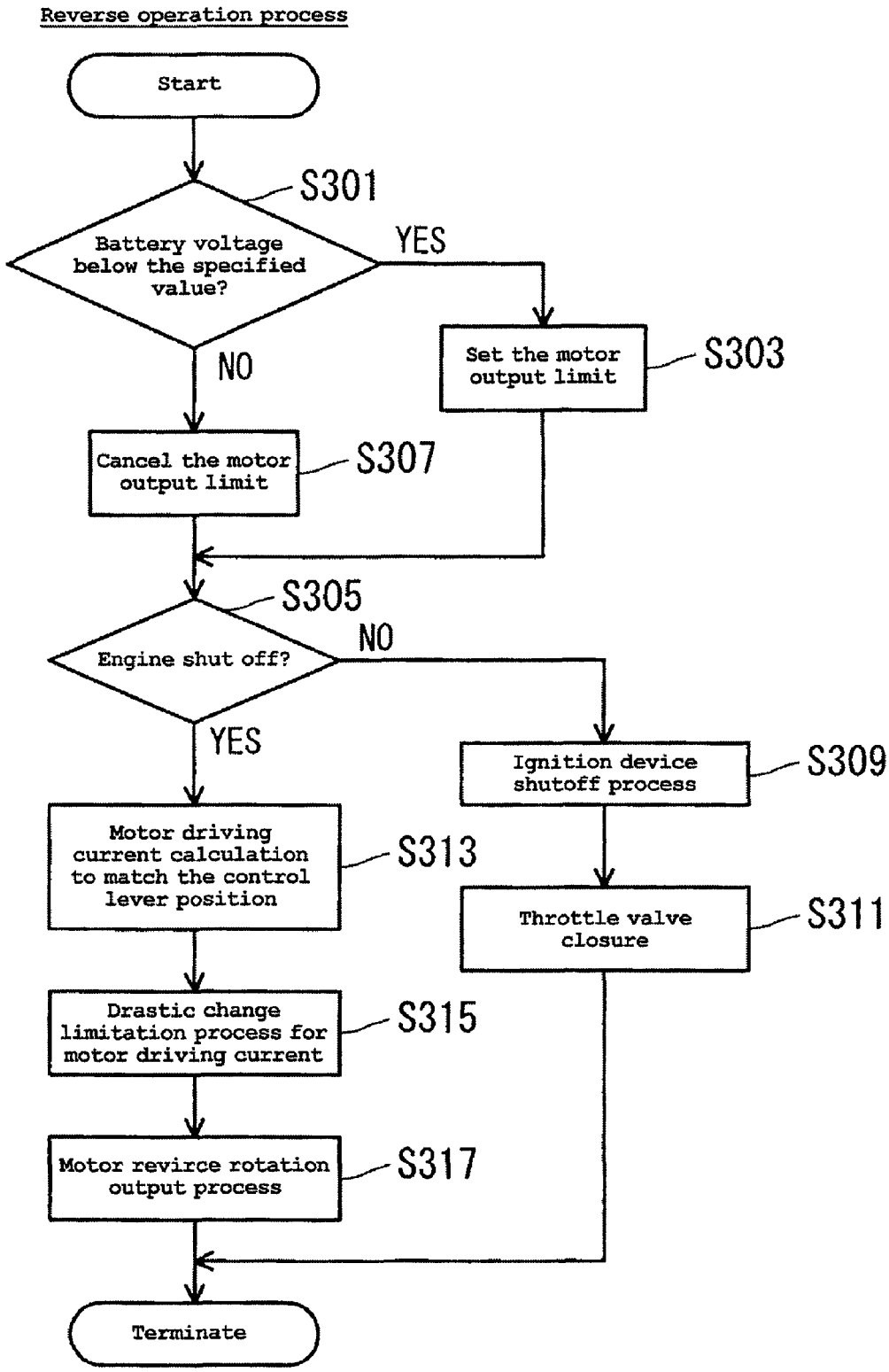
FIG. 9 is a flow chart showing an example of a reverse operation process according to the embodiment shown in FIG. 8.

An operation example regarding the reverse operation process of the watercraft propulsion system 10*a* will be described with reference to FIG. 9.

When the controller 42 determines that the operating mode is the reverse mode, the propeller driving mode is set to the first mode, and the step S301 and the subsequent processes are implemented.

First, the controller 42 determines whether the voltage of the battery 52 is below the specified value or not (step S301).

If the battery voltage is below the specified value, the controller 42 determines the motor driving mode to be a fifth mode, in which the output power of the electric motor 16 is restricted so that it is driven by electric power from the battery 52. In other words, the process goes to step S303. The restriction on the output power of the electric motor 16 is set in step S303, and the process goes to step S305.

On the other hand, if the battery voltage is not below the specified value, the controller 42 determines the motor driving mode to be a sixth mode, in which the electric motor 16 is driven by the electric power from the battery 52 without restricting the output power of the electric motor 16. In other words, the process goes to step S307. The restriction on the output power of the electric motor 16 is removed in step S307, and the process goes to step S305.

In step S305, determination is made whether the engine 14 is shut off or not. If the engine 14 is running, the shutoff process for the ignition device 32 is implemented (step S309), and the throttle valve 34 is closed (step S311).

If the engine 14 is shut off in step S305, the controller 42 calculates the electric motor driving current with reference to the table data showing the corresponding relations of FIG. 3, so that the motor output power is obtained in response to the position of the operating lever 46 (step S313). Then, the drastic change limiting process for motor driving current is implemented (step S315), and the reverse rotation output process for the electric motor 16 is implemented (step S317). In another embodiment, after the engine is shut off as in steps S309 and 5311, the process moves to step S313.

Through the processes described above, the watercraft propulsion system 10*a* runs backward by rotating the propeller 12 in reverse. The process is then terminated.

According to this operation example, the propeller 12 can be driven by the electric motor 16 without fail in the first mode, because the output power of the electric motor 16 is adjusted in response to the battery voltage.

Figure 10:
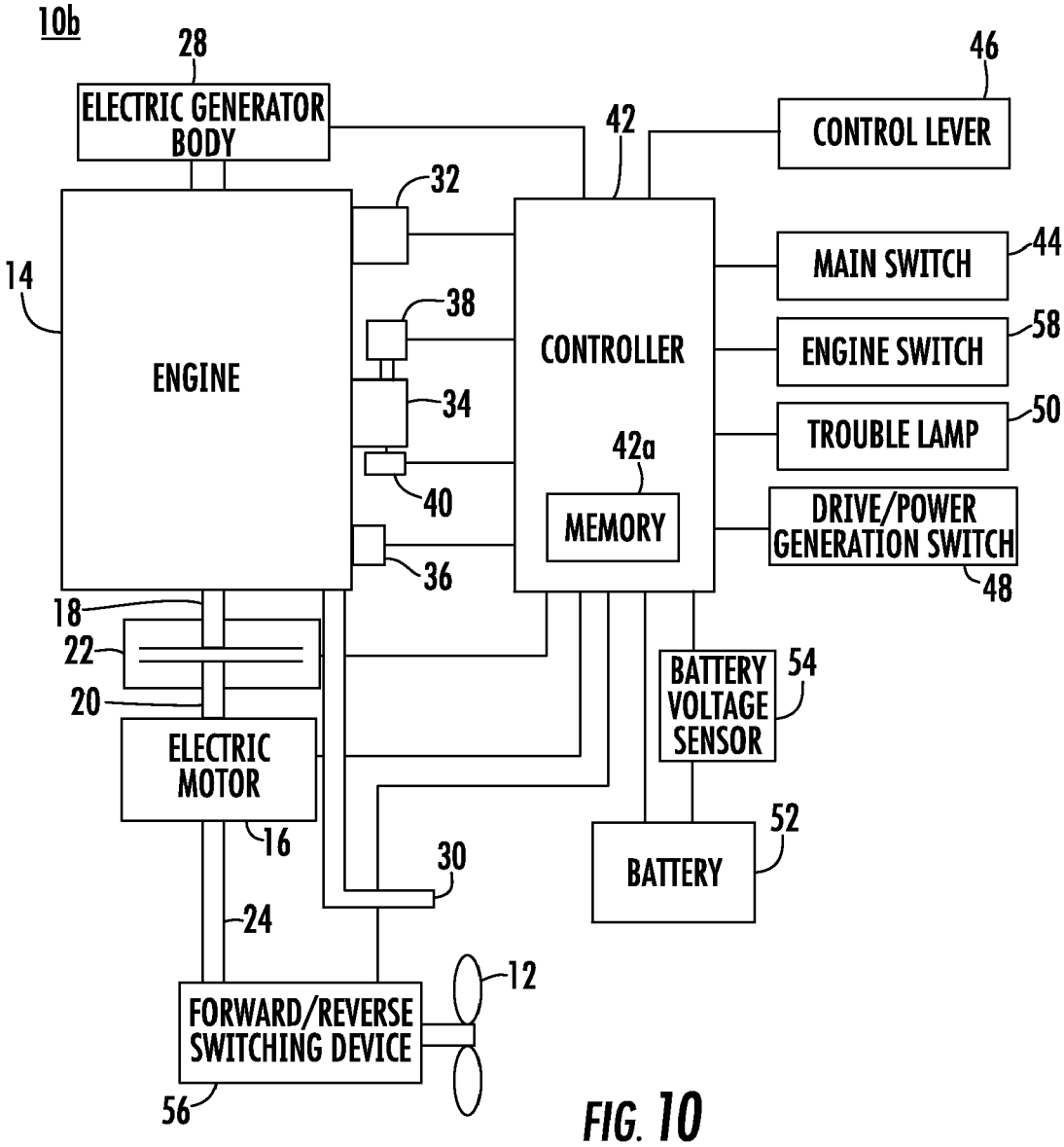
FIG. 10 is an illustration showing a watercraft propulsion system according to another embodiment.

A watercraft propulsion system 10*b* according to another embodiment will be described with reference to FIG. 10.

The watercraft propulsion system 10*b* is additionally provided with a forward/reverse switching device 56 to replace the bevel gear 26, and an engine switch 58 connected to the controller 42.

The forward/reverse switching device 56 sets the rotational direction of the propeller 12 either to the positive rotation by which the watercraft propulsion system 10*b* runs forward, or to the reverse rotation by which the watercraft propulsion system 10*b* runs backward according to the instruction given by the controller 42. The forward/reverse switching device 56 preferably is a common dog clutch as can be found on outboard motors, for instance, that is operated by an electric actuator.

The engine switch 58 represents a switch to change between using or not using the electric motor 16 for driving the propeller. Such a switch 58 may have any suitable structure. Also, a program for implementing the operations shown in FIGS. 11 and 12, first and the second thresholds to be compared with the battery voltage, first and the second prescribed values to be compared with the rpm of the engine 14, and so on are stored in the memory 42*a*. The rest of the configuration in the illustrated embodiment is generally the same as or similar to the watercraft propulsion system 10, and the description for duplicate parts will be skipped.

Figure 11:
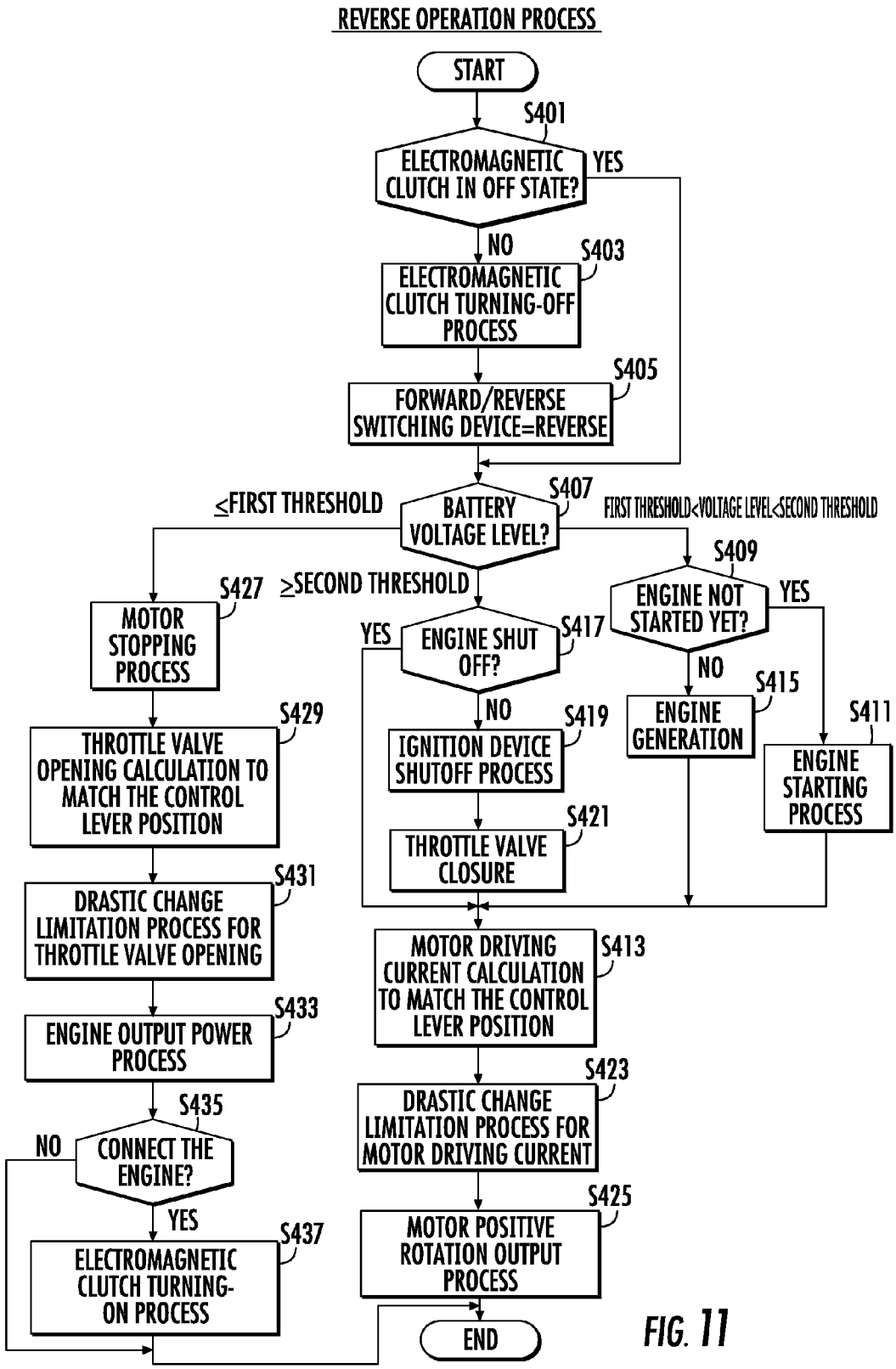
FIG. 11 is a flow chart showing an example of a reverse operation process according to the embodiment shown in FIG. 10.

An operation example regarding the reverse operation process of the watercraft propulsion system 10*b* will be described with reference to FIG. 11.

First, the controller 42 determines whether the electromagnetic clutch 22 is turned off or not (step S401). If the electromagnetic clutch 22 is turned on, the turning-off process for the electromagnetic clutch 22 is implemented by the controller 42 (step S403), the forward/reverse switching device 56 is set to reverse (so that the propeller 12 rotates in reverse) (step S405), and the process goes to step S407. If the electromagnetic clutch 22 is turned off, the process goes to step S407 directly.

In step S407, the controller 42 compares the voltage of the battery 52 with the first threshold, and with the second threshold. When the first threshold is below the battery voltage (first threshold<battery voltage), the controller 42 sets the propeller driving mode to the first mode.

When the first threshold is below the battery voltage and the battery voltage is below the second threshold (first threshold<battery voltage<second threshold), the controller 42 determines the motor driving mode to be a third mode, and the determination is made whether the engine has not been started yet (step S409). If the engine has not been started yet, the engine starting process is implemented (step S411), and the process goes to step S413.

On the other hand, if the engine has already been started in step S409, the engine speed is controlled to obtain the prescribed amount of power generation, the engine power generation is implemented (step S415), and then, the process goes to step S413.

When the battery voltage is equal or larger than the second threshold (battery voltage.gtoreq.second threshold) in step S407, the controller 42 determines the motor driving mode to be a fourth mode, and the determination is made whether the engine 14 is shut off or not (step S417). If the engine 14 is shut off, the process goes to step S413, but if the engine 14 is running, the shutoff process for the ignition device 32 is implemented (step S419), the throttle valve 34 is closed (S421), and the process then goes to s413.

In step S413, the controller 42 calculates the electric motor driving current with reference to the table data showing the corresponding relations of FIG. 3, so that the motor output power is obtained in response to the position of the operating lever 46. Then, the drastic change limiting process is implemented to prevent the electric motor driving current from changing sharply (step S423), and the positive rotation output process for the electric motor 16 is implemented (step S425).

If the battery voltage is equal to or smaller than the first threshold in step S407, the controller 42 sets the propeller driving mode to the second mode in which the propeller 12 is rotated in reverse powered by the engine 14, and at the same time the amount of output power from the engine 14 is adjusted according to the instruction given by the control lever 46. In other words, step S427 and the subsequent processes are implemented.

In step S427, a stopping process for the electric motor 16 is implemented, and the controller 42 calculates the opening of the throttle valve 34 with reference to table data showing the corresponding relations of FIG. 3, so that the engine output power is obtained in response to the position of the control lever 46 (step S429). A drastic change limiting process is then implemented to prevent the opening of the throttle valve 34 from changing sharply (step S431), and the output power process for the engine 14 is implemented (step S433). Determination is made whether the engine 14 is to be connected or not, namely, whether the electromagnetic clutch 22 is to be turned on or not (step S435). The process is terminated if the engine rpm is below the first prescribed value (1200 rpm, for instance). If the engine rpm is at or higher than the first prescribed value, it is determined that the engine 14 can be connected, and the electromagnetic clutch 22 turning-on process is implemented (step S437).

Through the processes described above, the watercraft propulsion system 10*b* runs backward by rotating the propeller 12 in reverse. The process is then terminated.

According to this operation example, use of the forward/reverse switching device 56 allows the rotational direction of the propeller 12 to be switched without changing the rotational direction of the electric motor 16, keeping the positive rotation of the electric motor 16.

Also, the propeller drive mode is set to the first mode or to the second mode, taking account of not only the operating mode, but also comparison between the battery voltage and the first threshold. For instance, even if the operating mode is instructed to be the reverse mode, sometimes it is hard to drive the propeller 12 by the electric motor 16 in the first mode when the battery voltage is equal to or below the first threshold (battery voltage first threshold). In such cases, the second mode can be used to drive the propeller 12.

Further in the first mode, the electric motor 16 is driven by the electric power supplied by the battery 52 when the battery voltage is equal to or larger than the second threshold (battery voltage.gtoreq.second threshold), while on the other hand, the electric motor 16 is driven by the electric power supplied by the battery 52, and in parallel, the electric power obtained by the engine power generation is charged into the battery 52 when the first threshold is below the battery voltage and at the same time the battery voltage is equal to or below the second threshold (first threshold<battery voltage.ltoreq.second threshold). In this way, deterioration of the battery 52 due to over discharge can be prevented.

In the second mode, the engine 14 is connected to the propeller 12 by turning-on the electromagnetic clutch 22 when the speed of the engine 14 exceeds the first prescribed value, thus the engine 14 is smoothly connected to the propeller 12.

Figure 12:
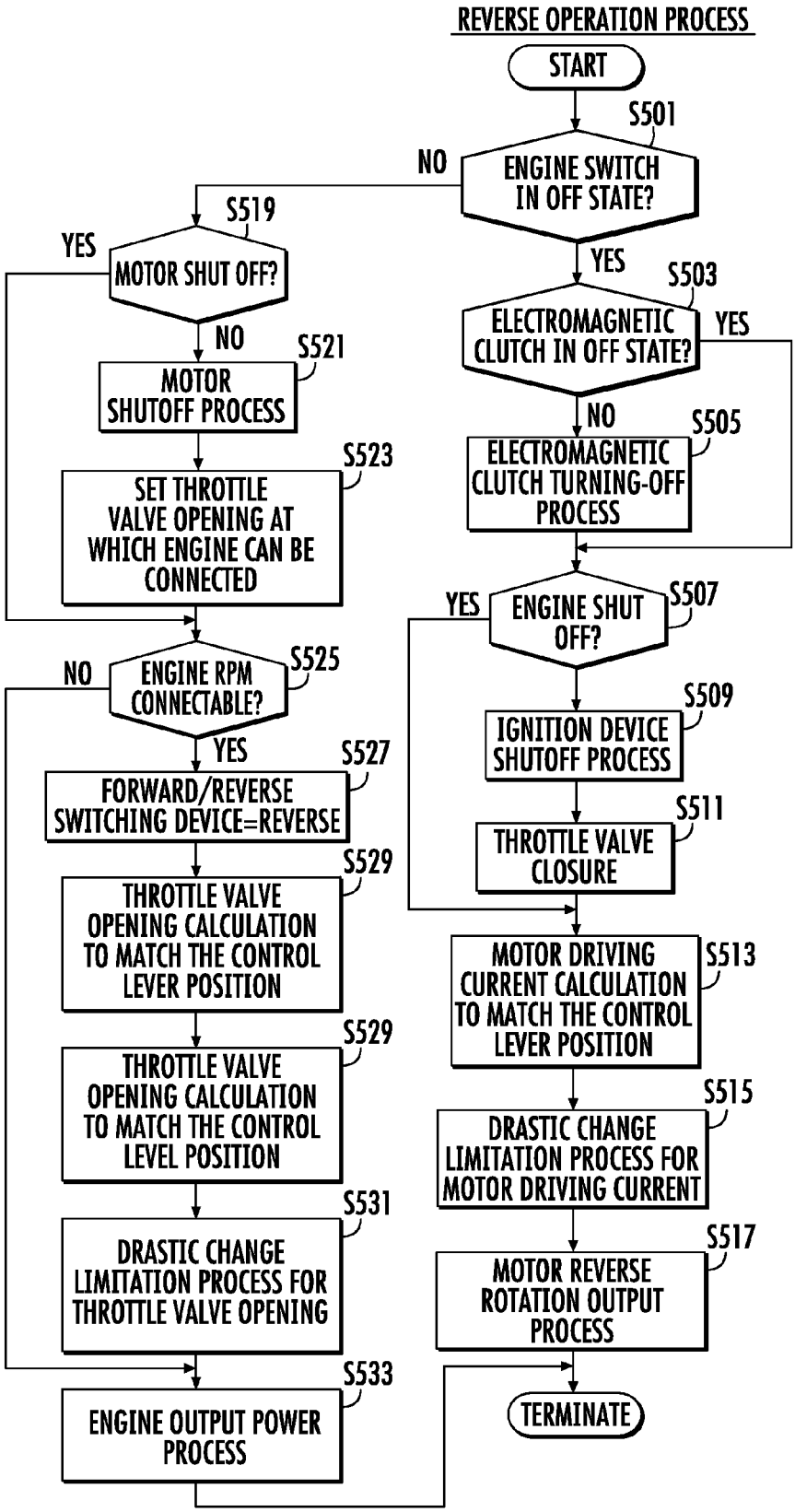
FIG. 12 is a flow chart showing another example of a reverse operation process.
Figure 13:
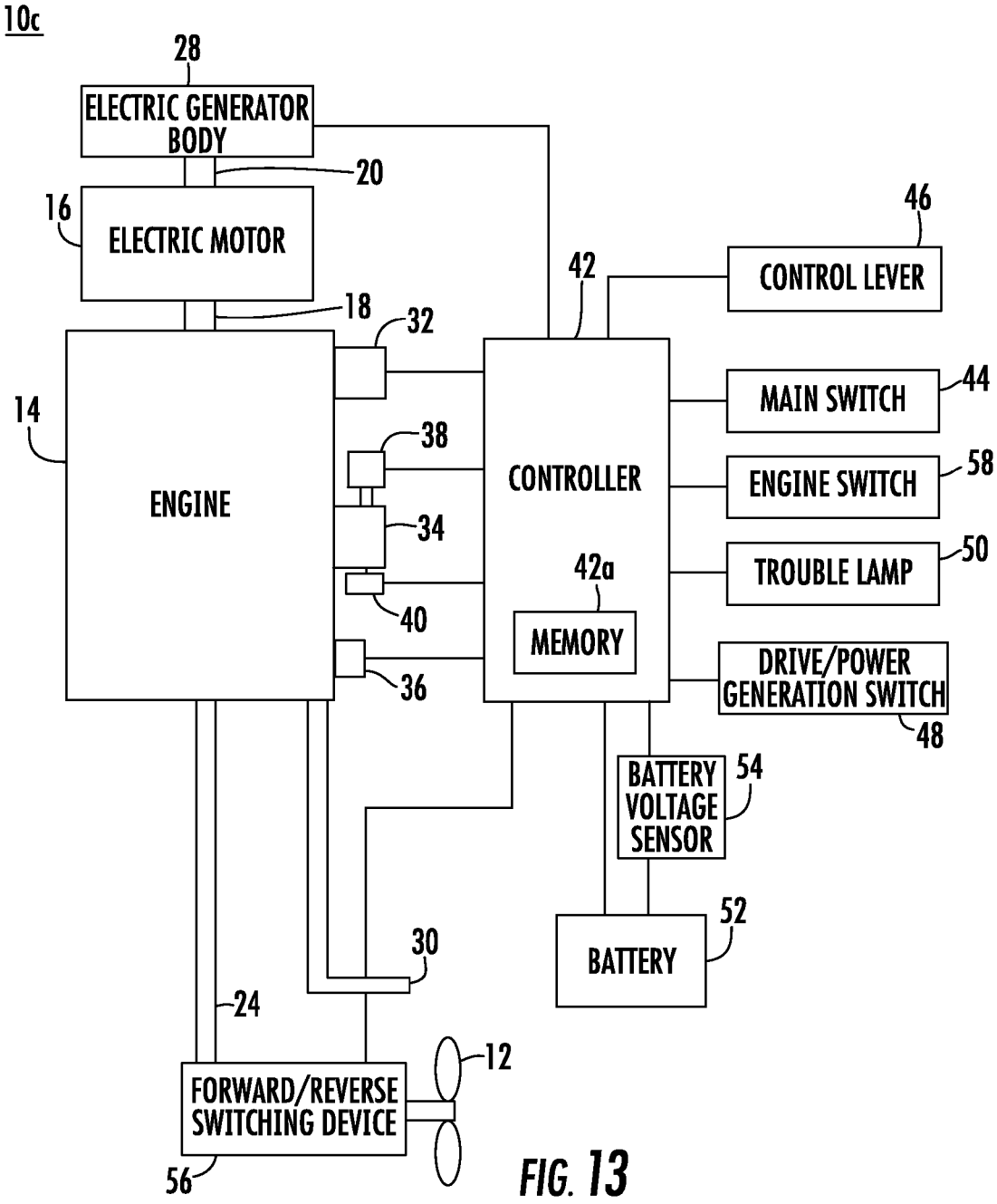
FIG. 13 is an illustration showing a watercraft propulsion system according to still another embodiment.

Another operation example regarding an embodiment of the reverse operation process for the watercraft propulsion system 10*b* will be explained with reference to FIG. 12.

First, the controller 42 determines whether the engine switch 58 is turned off or not (step S501). If the engine switch 58 is turned off, the controller 42 sets the propeller driving mode to the first mode. In other words, the process goes to step S503, and the following process is implemented.

In step S503, determination is made whether the electromagnetic clutch 22 is turned off or not. If the electromagnetic clutch 22 is turned on, the turning-off process for the electromagnetic clutch 22 is implemented by the controller 42 (step S505), and the process goes to step S507. If the electromagnetic clutch 22 is turned off, the process goes to step S407 directly.

In step S507, determination is made if the engine 14 is shut off or not. If the engine 14 is running, the shutoff process for the ignition device 32 is implemented (step S509), the throttle valve 34 is closed (step S511), and the process goes to step S513. If the engine 14 is stopped, the process goes to s513 directly.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A method for operating a watercraft propulsion system including an internal combustion engine and an electric motor that are both configured to selectively drive a propeller and that are both controlled by a controller, the method comprising the steps of:

receiving a user instruction selecting a reverse operating mode and an output power in the reverse operating mode;

sensing a battery charge level;

driving the propeller in the reverse operating mode with the electric motor; and based on the sensed battery charge level, adjusting a power output of the internal combustion engine; wherein if the sensed battery charge level is below a threshold level, further comprising the steps of:

operating the internal combustion engine without being connected to the propeller and charging the battery with an electricity generator; and driving the propeller in the reverse operating mode with the electric motor.

2. A method for operating a watercraft propulsion system including an internal combustion engine and an electric motor that are both configured to selectively drive a propeller and that are both controlled by a controller, the method comprising the steps of:

receiving a user instruction selecting a reverse operating mode and an output power in the reverse operating mode;

sensing a battery charge level;

driving the propeller in the reverse operating mode with the electric motor; and based on the sensed battery charge level, adjusting a power output of the internal combustion engine; wherein if the sensed battery charge level is above a threshold level, further comprising the step of:

stopping the internal combustion engine.

3. A method for operating a watercraft propulsion system including an internal combustion engine and an electric motor that are both configured to selectively drive a propeller and that are both controlled by a controller, the method comprising the steps of:

receiving a user instruction selecting a reverse operating mode and an output power in the reverse operating mode;

sensing a battery charge level;

driving the propeller in the reverse operating mode with the electric motor; and based on the sensed battery charge level, adjusting a power output of the internal combustion engine; wherein if the sensed battery charge level is above a threshold level, further comprising the step of:

idling the internal combustion engine without being connected to the propeller and without charging the battery with an electricity generator.

* * * * *